United States Patent [19]

Dutkanych

[11] Patent Number: 4,697,836

[45] Date of Patent: Oct. 6, 1987

[54] BIN WITH RETRACTABLE LID

[75] Inventor: Thomas A. Dutkanych, O'Fallon, Ill.

[73] Assignees: Howard D. Hamilton; Laura M. Hamilton, both of O'Fallon, Ill.

[21] Appl. No.: 891,640

[22] Filed: Aug. 1, 1986

[51] Int. Cl.[4] ..... B65F 1/12

[52] U.S. Cl. ..... 294/68.2; 414/407

[58] Field of Search ..... 294/68.2, 68.1, 68.26, 294/68.25; 414/406, 407, 408, 414, 607, 608; 100/58, 56

[56] References Cited

U.S. PATENT DOCUMENTS 4,155,584 5/1979 Pracchia ..... 294/68.1

FOREIGN PATENT DOCUMENTS 282107 5/1965 Australia ..... 414/406

*Primary Examiner*—James B. Marbert

*Attorney, Agent, or Firm*—Senniger, Powers, Leavitt and Roedel

[57] ABSTRACT

A bin for holding material and expelling it when the bin is inverted, the bin comprising a bottom, and front, rear, and side walls extending generally upwardly from the bottom, an opening in the top, a lid mounted pivotally over the opening in tracks so that the lid freely pivots open and so that the lid can slide upwardly a relative to the bin in response to applied pressure when the bin is inverted.

17 Claims, 4 Drawing Figures

BIN WITH RETRACTABLE LID

BACKGROUND AND SUMMARY OF THE INVENTION

This invention relates to a bin with a retractable lid, and in particular to a garbage bin or the like with an improved lid construction which facilitates emptying the bin when it is inverted and which the allows the lid to retract in response to applied pressure.

Trash bins or dumpsters having one or more hinged lids are widely used. These bins usually have side brackets so that the bins can be engaged by garbage collection trucks. The truck engages a bin, lifts it, and inverts it over a collection receptacle so that the lid can swing open and the contents can fall out. However, as the bin is inverted the free end of the lid may be caught on the truck or on the accumulating garbage. Further movement of the bin causes the lid to buckle or crush in response to the applied pressure. A damaged lid does not properly close the bin, allowing animals and vermin and rain to enter the bin, and allowing odors to escape.

Some bins are made tall to increase their volume, and a sloped lid is provided to make it easier to open and to fill the bin. These tall bins often have a flat top portion to maximize the volume of the bin and reduce the size of the lid. This flat top portion can trap some of the garbage when the bin is inverted, with the result that the bin is not completely emptied.

In view of these problems, it is an object of this invention to provide a bin with a lid construction that protects the lid from being crushed when the bin is inverted, and in particular allows the lid to retract in response to applied pressure. It is further an object of this invention to provide a retractable lid that is inexpensive and of simple and sturdy construction to provide a reliably operating lid capable of withstanding in service abuse. It is also an object of this invention to provide a retractable lid that is easy to open when the bin is upright. It is also an object of this invention to provide a construction that facilitates the complete emptying of the bin when it is inverted.

The bin of this invention comprises a bottom and a front wall, rear wall, and two opposing sidewalls extending upwardly from the bottom. The sidewalls preferably have a peaked top edge with an upwardly, rearwardly sloping front portion and a downwardly, rearwarly sloping rear portion. A downwardly, rearwardly sloping top panel extends between the rear portions of the sidewalls, adjacent the rear wall. The front wall, sidewalls, and top panel define an upwardly, rearwardly sloping opening.

In the preferred embodiment downwardly, rearwardly sloping track members are mounted over the top panel. Each track member has a longitudinal slot therein. A rod extends between and is slideably mounted in the slots. At least one lid is mounted to the rod so that when the rod is in the upper portions of the slots the lid covers the opening. The lid freely pivots, and when the bin is inverted, the lid swings open. The rod slides freely in the slots when the bin is inverted, allowing the lid to slide upwardly in response to applied pressure, thereby protecting the lid from being crushed. The sloped top panel helps to channel the contents of the bin through the opening when the bin is inverted.

A downwardly depending notch can be provided in the upper portion of the slots to engage the rod when the bin is upright to allow the lid to be easily pivoted open but preventing the rod from sliding in the slots.

The bin of this construction is thus of simple and inexpensive construction. The bin allows the lid to retract in response to applied pressure when it is inverted, to protect the lid from being crushed. As the applied pressure is relieved, the lid slides freely back to its proper position. The bin also has means to prevent the lid from sliding when the bin is upright so that the lid is easy to operate. The sloped top panel helps to channel the contents of the bin out the opening when the bin is inverted, preventing any of the contents from being trapped in the bin and allowing the bin to be completely emptied.

These and other advantages of the invention will be more apparent with reference to the preferred embodiment described below.

DETAILED DESCRIPTION OF THE PREFERRED EMBODIMENT

Figure 1:
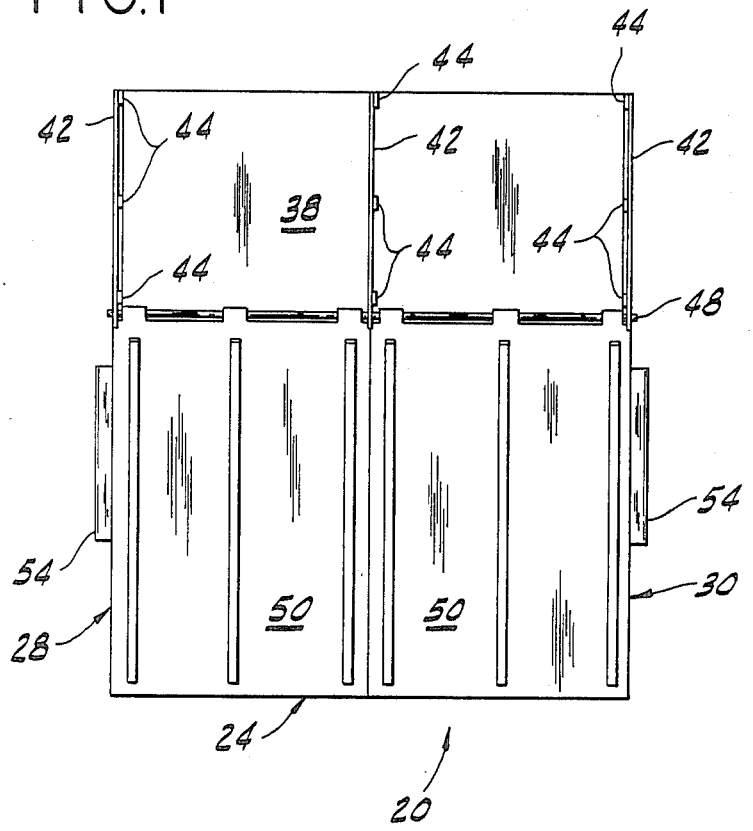
FIG. 1 is a top plan view of a bin constructed according to the principles of this invention.
Figure 2:
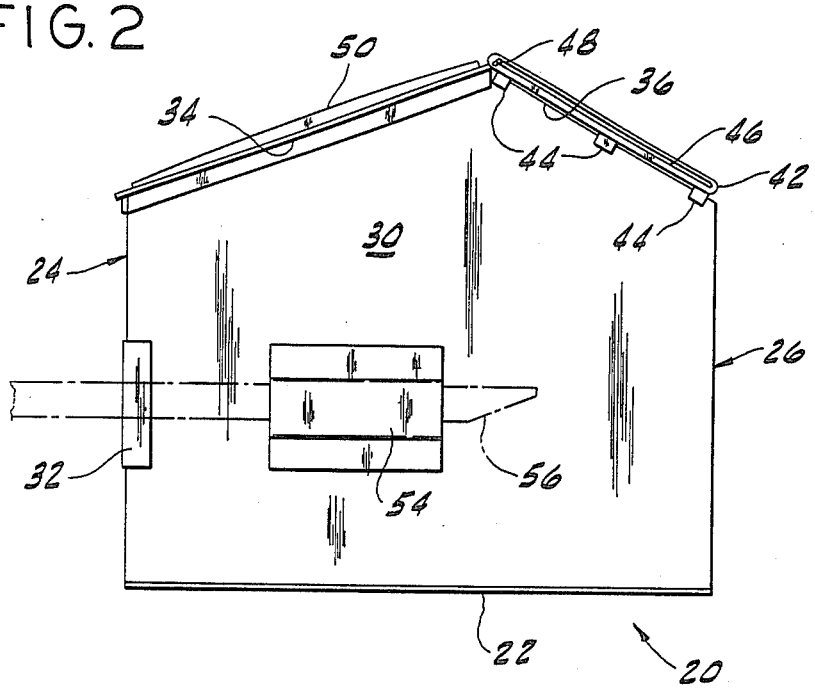
FIG. 2 is a right side elevation view of the bin, showing in phantom the engagement by an arm from a collection truck.
Figure 4:
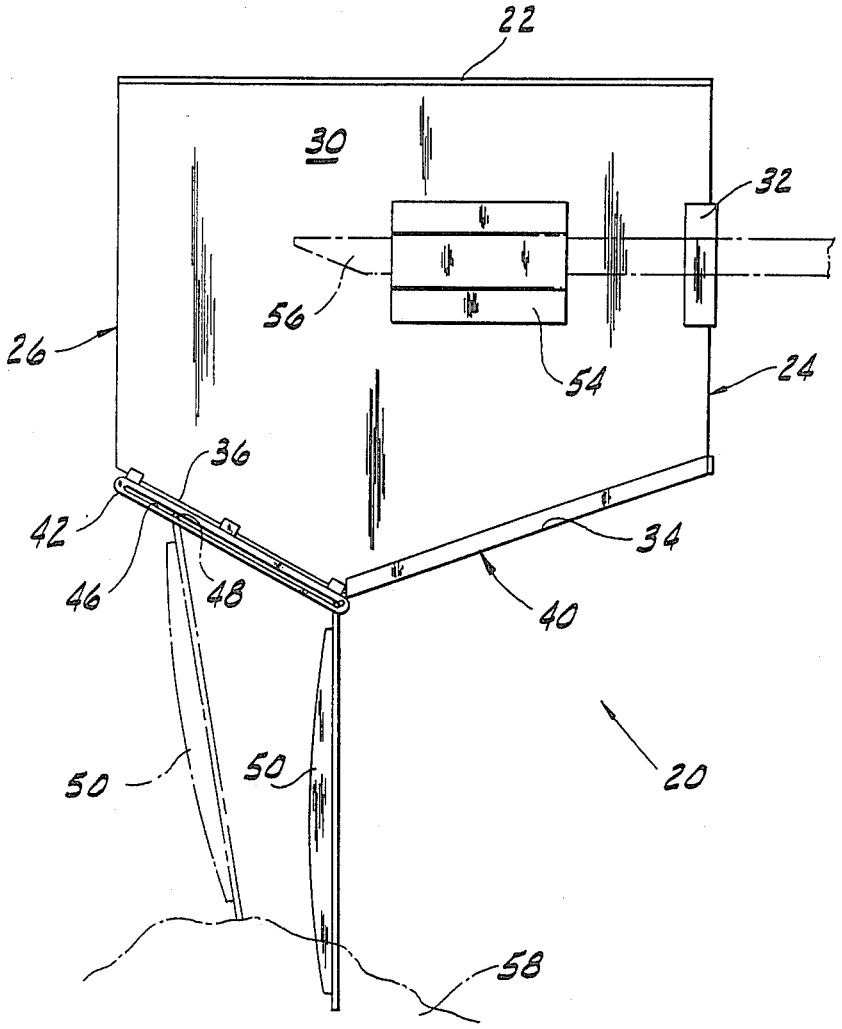

A bin constructed according to the principles of this invention is indicated generally as 20 in FIGS. 1, 2, and 4. Bin 20 comprises a bottom 22, a front wall 24, a rear wall 26, and left and right sidewalls 28 and 30, all extending upwardly from bottom 22. The bottom 22 and the walls 24, 26, 28, and 30 may be joined with welds. Corner support brackets 32 may be provided at the corners of bin 20.

Each sidewall 28 and 30 has a peaked top edge with an upwardly, rearwardly sloping front portion 34 and a downwardly, rearwardly sloping rear portion 36. In the preferred embodiment, the front portion 34 slopes upwardly at an angle of between about 15 and 25 degrees and preferably approximatly 20 degrees with respect to horizontal and the rear portion 36 slopes downwardly at an angle of between about 50 and 70 degrees and preferably approximately 60 degress with respect to horizontal. A downwardly, rearwardly sloping top panel 38 extends between the rear portions 36 of sidewalls 28 and 30, adjacent rear wall 26. The front wall 24, front portions 34 sidewalls 28 and 30, and top panel 38 define an upwardly, rearwardly sloping top opening 40.

Figure 3:
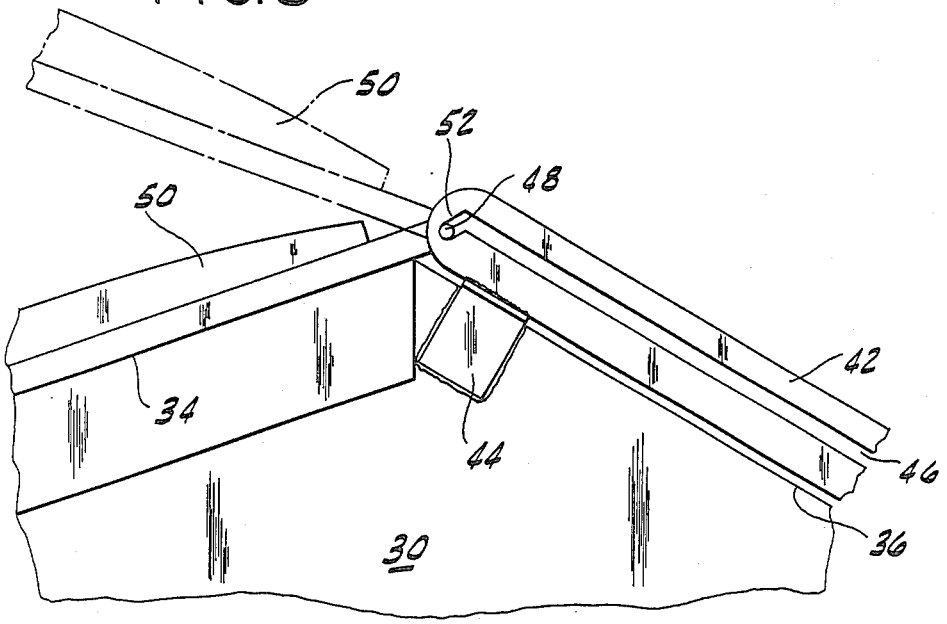
FIG. 3 is an enlarged, partial right side elevation view of the bin showing the details of the mounting of the lid, and showing in phantom the lid pivoted open; and, FIG. 4 is a right side elevation view of the bin inverted for emptying, showing in phantom the lid in the retracted position.

In the preferred embodiment three elongated track members 42 are mounted generally parallel to top panel 38 with L-shaped brackets 44. Track members 42 thus slope downwardly and rearwardly. It should be understood that track members 42 could be mounted along a surface of a bin of another construction, and do not necessarily have to slope downwardly and rearwardly. It is preferred that the track members extend at least somewaht downwardly so that, as described below, when the bin is inverted, the lid can travel upwardly reducing the amount of clearance required below the bin. Also, the lid will be restored by gravity to its proper position before the bin is returned to its upright position. Each track member 42 has a longitudinal slot 46 therein. As best shown in FIG. 1, a rod 48 extends between, and is slidably mounted in the slots 46 of track members 42. Two lids 50 are mounted on rod 48. Lids 50 cover opening 40 when rod 48 is in the upper most portions of slots 46. The lids 50 are pivotally mounted to allow the lids 50 to be opened to access the interior of bin 20. As best shown in FIG. 3, in the preferred embodiment each slot 46 has a downwardly depending notch 52 in its upper portion to engage rod 48 when bin 20 is upright to prevent rod 48, and thus lids 50, from sliding in slots 46, but allowing lids 50 to freely pivot. The lid 50 are shown pivoted to an open position in phantom in FIG. 3.

Brackets 54 are mounted on sidewalls 28 and 30 of bin 20. As shown in FIG. 2, brackets 54 are adapted to be engage by the arms 56 (in phantom) of a collection device such as a garbage collection truck. The truck engages bin 20, lifts it, and inverts it. As shown in FIG. 4, when the bin 20 is inverted, lids 50 swing open allowing the contents to spill out the opening 40. Top panel 38 helps to channel the contents of bin 20 out through opening 40.

As the bin is inverted the free ends of the lids 50 can engage a part of the truck or the accumulating pile of garbage 58, shown in phantom in FIG. 4. With a prior art bin having a rigidly mounted lid, further motion of the bin would cause the lid to buckle or crush in response to the applied pressure. However, with the present invention, as shown in FIG. 4, rod 48 supporting lids 50 can slide upwardly in slots 46 in response to pressure applied to the lids 50. This allows lids 50 to retract in response to the applied pressure. As bin 20 is restored to its upright position, rod 48 slides downwardly in slot 46, allowing lids 50 to slide back down so that when bin 20 is turned upright, rod 48 is engaged in notches 52 and lids 50 swing closed over opening 40.

Operation

The bin 20 is provided upright with rod 48 engaged in notches 52 of slot 46 so that lids 50 can be freely pivoted open to insert garbage into bin 20 without the lids 50 sliding. When bin 20 is filled, a collection truck can engage brackets 54 with arms 56, lifting bin 20 and inverting it. As bin 20 is inverted, rod 48 falls out of notches 52 and can freely slide in slots 46. Also as bin 20 is inverted, lids 50 swing open. If the free ends of lids 50 engage part of the truck, the accumulating garbage, or some other obstacle rods 48 can slide upwardly in slots 46, allowing lids 50 to retract. The contents of bin 20 can spill out opening 40. As bin 20 is restored to its upright position, the lids 50 disengage the obstruction and the lids 50 and rod 48 slide back down so that when bin 20 is returned to an upright position, rod 48 is engaged in notches 52 and lids 50 swing closed over opening 40.

There are various changes and modifications which may be made to the inventor's invention as are apparent to those skilled in the art. However, any of those changes or modification are included in the teachings of this disclosure, and it is intended that the invention be limited only by the scope of the claims appended hereto.

What is claimed is:

1. A bin for holding material and expelling it when the bin is inverted, the bin comprising:

a bottom;

a front wall, a rear wall, and two opposing sidewalls extending generally upwardly from the bottom, the sidewalls having a peaked top edge with an upwardly, rearwardly sloping front portion and a downwardly, rearwardly sloping rear portion;

a downwardly, rearwardly sloping top panel adjacent the rear wall and extending between the rear portions of the sidewalls;

the front wall, sidewalls, and top panel defining an upwardly, rearwardly sloping opening, the top panel channeling the contents of the bin out the opening when the bin is inverted;

at least one lid;

means for pivotally mounting the lid over the opening, the lid swinging open and depending downwardly when the bin is inverted, the mounting means including means for allowing the lid to slide relative to the bin in response to an applied force when the bin is inverted.

2. The bin of claim 1 wherein the mounting means comprises:

at lease one downwardly, rearwardly sloping track mounted on the bin parallel to the top panel;

a track engaging means mounted on the lid, the track engaging means sliding in the track in response to a force applied to the lid when the bin is inverted to allow the lid to slide.

3. The bin of claim 2 further comprising means for engaging the track engaging means when the bin is upright and releasing the track engaging means when the bin is inverted.

4. The bin of claim 1 wherein the mounting means comprises a downwardly, rearwardly sloping track member at each side of the lid and extending generally parallel to the top panel, each track member having a longitudinal slot therein; a rod extending between and sliding in the slots; and means for mounting the lid on the rod, the rod sliding in the slots to allow the lid to slide generally upwardly in response to applied pressure when the bin is inverted.

5. The bin of claim 4 further comprising a downwardly depending notch in the upper portion of each slot, the notch engaging the rod when the bin is upright to prevent the rod from sliding in the slots.

6. A bin for holding material and expelling it when the bin is inverted, the bin comprising:

a bottom;

a front wall, a rear wall, and two opposing sidewalls;

an opening in the top;

at least one lid for covering the opening;

at least one track mounted to the bin and sloping generally downwardly;

track engaging means mounted to the lid, the track engaging means sliding in the track and allowing the lid to slide in response to applied pressure when the bin is inverted.

7. The bin of claim 6 wherein the track means comprises a track member at each side of the lid, each track member having a longitudinal slot therein, and wherein the track engaging means comprises a rod extending between and sliding in the slots, the rod sliding in the slot to allow the lid to slide generally upwardly in response to applied pressure when the bin is inverted.

8. The bin of claim 7 further comprising a downwardly depending notch in the upper portion of each slot, the notch engaging the rod when the bin is upright to prevent the rod from sliding in the slots.

9. An improved bin for holding material and expelling it when the bin is inverted, the bin of the type having bottom, a front wall, a rear wall, and two opposing sidewalls extending generally upwardly from the bottom, an opening in the top, and a lid pivotally mounted over the opening, the lid swinging open and depending downwardly when the bin is inverted, the improvement comprising:

means for allowing the lid to slide upwardly relative to the inverted bin in response to applied pressure when the bin is inverted.

10. The improved bin of claim 9 further comprising means for preventing the lid from sliding when the bin is upright.

11. A bin for holding material and expelling it when the bin is inverted, the bin comprising:

a bottom;

a front wall, a rear wall, and two opposing sidewalls extending generally upwardly from the bottom, the sidewalls having a peaked top edge with an upwardly, rearwardly sloping front portion and a downwardly, rearwardly sloping rear portion;

a downwardly, rearwardly sloping top panel adjacent the rear wall and extending between the rear portions of the sidewalls;

the front wall, sidewalls, and top panel defining an upwardly, rearwardly sloping opening, the top panel channeling the contents of the bin out the opening when the bin is inverted;

at least one lid;

a downwardly, rearwardly sloping track member extending generally parallel to the top panel at each side of each lid, said track member having a longitudinally extending slot therein;

a rod extending between and sliding in the slots in the track members;

means for mounting the lid to the rod, the lid freely pivoting over the opening and swinging open and depending downwardly when the bin is inverted;

the rod sliding in the slots to allow the lid to slide generally upwardly in response to applied pressure when the bin is inverted.

12. The bin of claim 11 further comprising a downwardly depending notch in the upper portion of each slot, the notch engaging the rod when the bin is upright to prevent the rod from sliding in the slots.

13. The bin of claim 11 wherein there are two lids and three track members, one track member at the side of each lid.

14. The bin of claim 11 wherein the upwardly, rearwardly sloping opening slopes at an angle of between about 15 and 25 degrees with respect to horizontal.

15. The bin of claim 14 wherein the upwardly, rearwardly sloping opening slopes at an angle of approximately 20 degrees with respect to horizontal.

16. The bin of claim 11 wherein the downwardly, rearwardly sloping top panel slopes at an angle of between about 50 and 70 degrees with respect to horizontal.

17. The bin of claim 16 wherein the downwardly, rearwardly sloping top panel slopes at an angle of approximately 59 degrees with respect to horizontal.

* * * * *